US012790734B2

(12) United States Patent
Zhao et al.

(10) Patent No.: US 12,790,734 B2
(45) Date of Patent: Nov. 10, 2026

(54) LIFT DEVICE FOR FRONT LOADING WASHING MACHINE AND FRONT LOADING WASHING MACHINE

(71) Applicants: QINGDAO HAIER WASHING MACHINE CO., LTD., Qingdao (CN); HAIER SMART HOME CO., LTD., Qingdao (CN)

(72) Inventors: Zhiqiang Zhao, Qingdao (CN); Sheng Xu, Qingdao (CN)

(73) Assignees: QINGDAO HAIER WASHING MACHINE CO., LTD., Qingdao (CN); HAIER SMART HOME CO., LTD., Qingdao (CN)

( * ) Notice: Subject to any disclaimer, the term of this patent is extended or adjusted under 35 U.S.C. 154(b) by 31 days.

(21) Appl. No.: 18/847,107

(22) PCT Filed: Mar. 1, 2023

(86) PCT No.: PCT/CN2023/078904
§ 371 (c)(1),
(2) Date: Sep. 13, 2024

(87) PCT Pub. No.: WO2023/174052
PCT Pub. Date: Sep. 21, 2023

(65) Prior Publication Data

US 2025/0376797 A1 Dec. 11, 2025

(30) Foreign Application Priority Data

Mar. 15, 2022 (CN) ..... 202210254090.1

(51) Int. Cl.
*D06F 37/06* (2006.01)
*D06F 39/08* (2006.01)

(52) U.S. Cl.
CPC ..... *D06F 37/065* (2013.01); *D06F 39/083* (2013.01)

(58) Field of Classification Search
CPC ..... D06F 37/065; D06F 39/083
(Continued)

(56) References Cited

FOREIGN PATENT DOCUMENTS

| | | | | |
|---|---|---|---|---|
| CN | 105951348 A * | 9/2016 | ..... | D06F 39/088 |
| CN | 111485374 A | 8/2020 | | |
| WO | WO-2021139518 A1 * | 7/2021 | ..... | D06F 37/065 |

OTHER PUBLICATIONS

CN105951348A—machine translation (Year: 2016).*
(Continued)

*Primary Examiner* — Tinsae B Ayalew
(74) *Attorney, Agent, or Firm* — Mahamedi IP Law LLP

(57) ABSTRACT

A lift device for a front loading washing machine, the device comprising: a casing having a chamber structure, and centrifugal assemblies, such as a valve body guide column, a valve core, a counterbalance weight guide column, a counterbalance weight part, a balance rod, and an elastic part in the chamber structure, the middle part of the balance rod being pivotally connected to the interior of the casing, a first end of the balance rod being hinged to a first end of the counterbalance weight guide column, a second end of the counterbalance weight guide column passing through the casing in a sliding mode and then being connected to the counterbalance weight part, the elastic part being arranged between the counterbalance weight guide column and the casing and used for restoring the position of the counterbalance weight part, a second end of the balance rod being hinged to a first end of the valve body guide column, and a second end of the valve body guide column being connected to the valve body after passing through the casing. The problem of a shortened service life because of unreasonable
(Continued)

arrangement of centrifugal assemblies of an existing lift device for a front loading washing machine is solved, and the centrifugal assemblies and a lever structure are arranged more reasonably.

8 Claims, 3 Drawing Sheets

(58) Field of Classification Search
USPC ..... 68/3 R
See application file for complete search history.

(56) References Cited

OTHER PUBLICATIONS

WO2021139518A1—machine translation (Year: 2021).*
China National Intellectual Property Administration, Office Action, CN Application No. 202210254090.1, dated Apr. 2, 2026, 6 pages.

* cited by examiner

LIFT DEVICE FOR FRONT LOADING WASHING MACHINE AND FRONT LOADING WASHING MACHINE

FIELD

The present disclosure relates to the technical field of washing machines, and specifically provides a lifting device for a drum washing machine, and a drum washing machine.

BACKGROUND

In existing drum washing machines, an outer cylinder is used to hold water and an inner cylinder rotates for washing; there may be dirt and bacterial growth between interlayers, and the filling of water between the inner cylinder and the outer cylinder causes the problem of useless water waste. In view of the above problem, the inventor has proposed a solution, namely, Chinese patent application No. 202010021697.6, the description of which discloses the structure of a drum washing machine with a hole-free inner cylinder, and discloses a centrifugal drainage assembly: "the centrifugal drainage assembly includes a centrifugal member that generates centrifugal motion under the action of centrifugal force, and the centrifugal member includes a connecting part and a counterweight member; one end of the connecting part is connected to the counterweight member, and the other end of the connecting part is rotatably connected to a sealing plunger; a middle portion of the connecting part is rotatably installed on a plunger seat, forming a lever structure". This patent proposes a solution of using the centrifugal assembly to achieve centrifugal drainage, so as to solve the drainage problem of the hole-free drum washing machine. However, after use, the inventor found that with increasing use of the washing machine, due to the unreasonable arrangement of the counterweight member, the increasing times of swinging thereof will cause the wear of rotating shaft, which further causes problems of noise production and structural instability, ultimately leading to untight blocking of drainage outlet and inability to adjust the centrifugal assembly, and eventually resulting in the replacement of the centrifugal assembly. In other words, the solution of the prior application still has the problem of insufficient service life. Based on this, the inventor continues to propose a new structure for improvement to make the drum washing machine less prone to noise production and have a longer service life.

Accordingly, there is a need for a new lifting device for a drum washing machine in the art to solve the problem of reduced service life caused by unreasonable arrangement of the centrifugal assembly in the lifting device of existing drum washing machines.

SUMMARY

The present disclosure aims to solve the above technical problem, that is, to solve the problem of reduced service life caused by unreasonable arrangement of the centrifugal assembly in the lifting device of existing drum washing machines.

In a first aspect, the present disclosure provides a lifting device for a drum washing machine, which includes a housing with a cavity structure; a centrifugal assembly is arranged inside the cavity structure, and the centrifugal assembly includes a valve body guide column, a valve core, a counterweight guide column, a counterweight member, a balancing rod, and an elastic member; a middle part of the balancing rod is pivotally connected inside the housing; a first end of the balancing rod is hinged to a first end of the counterweight guide column, a second end of the counterweight guide column is connected to the counterweight member after passing through a first through hole on the housing, and the counterweight guide column is slidably arranged in the first through hole; the elastic member is arranged between the counterweight guide column and the housing, and is used to reset the position of the counterweight member; a second end of the balancing rod is hinged to a first end of the valve body guide column, a second end of the valve body guide column is connected to the valve core after passing through a second through hole on the housing, and the valve body guide column is slidably arranged in the second through hole.

In a preferred technical solution of the lifting device for a drum washing machine described above, the housing includes a cover shaped lifting rib shell and a bracket arranged at an opening of the lifting rib shell, and the first through hole and the second through hole are arranged on the bracket.

In a preferred technical solution of the lifting device for a drum washing machine described above, the counterweight guide column includes a first connecting lug and a first sliding rod arranged on the first connecting lug; the first end of the balancing rod is hinged to the first connecting lug, and a boss is arranged between the first connecting lug and the first sliding rod; the elastic member is a spring, which is sleeved on the first sliding rod; one end of the spring is abuts against the boss, and the other end of the spring abuts against an inner surface of the bracket.

In a preferred technical solution of the lifting device for a drum washing machine described above, the first sliding rod is threaded with the counterweight member, and the counterweight member abuts against an outer surface of the bracket.

In a preferred technical solution of the lifting device for a drum washing machine described above, a size of the counterweight member is larger than a size of the first through hole, and/or a size of the valve core is larger than a size of the second through hole.

In a preferred technical solution of the lifting device for a drum washing machine described above, the valve body guide column includes a second connecting lug and a second sliding rod arranged on the second connecting lug; the second end of the balancing rod is hinged to the second connecting lug, the valve core is detachably connected to the second sliding rod, and a sealing member is also arranged at the top of the valve core.

In a preferred technical solution of the lifting device for a drum washing machine described above, an annular sealing rib is also arranged at the bottom of the sealing member.

In a preferred technical solution of the lifting device for a drum washing machine described above, a support seat is arranged on the bracket, and a middle part of the balancing rod is pivotally connected to the support seat; and/or water passing holes are arranged on the lifting rib shell.

In a preferred technical solution of the lifting device for a drum washing machine described above, the counterweight member and the counterweight guide column are separately arranged or integrally formed; and/or the valve body guide column and the valve core are separately arranged or integrally formed.

The present disclosure also provides a drum washing machine, which includes an outer cylinder, and an inner cylinder that is rotatably arranged inside the outer cylinder; the inner cylinder is provided with a clothing inlet that cooperates with a door of the washing machine, a water inlet connected to a water inflow pipe, and a water outlet; the lifting device for a drum washing machine is provided on the water outlet, and the valve core of the lifting device is arranged at the water outlet, so that when the door is closed, the water inlet is closed and the valve core blocks the water outlet, the inner cylinder is a closed chamber, and when the door is closed, the water inlet is closed and the valve core disengages from the water outlet, the inner cylinder can drain water normally.

It can be understood by those skilled in the art that in the technical solutions of the present disclosure, the lifting device for a drum washing machine includes a housing with a cavity structure; a centrifugal assembly is arranged inside the cavity structure, and the centrifugal assembly includes a valve body guide column, a valve core, a counterweight guide column, a counterweight member, a balancing rod, and an elastic member; a middle part of the balancing rod is pivotally connected inside the housing; a first end of the balancing rod is hinged to a first end of the counterweight guide column, a second end of the counterweight guide column is connected to the counterweight member after passing through a first through hole on the housing, and the counterweight guide column is slidably arranged in the first through hole; the elastic member is arranged between the counterweight guide column and the housing, and is used to reset the position of the counterweight member; a second end of the balancing rod is hinged to a first end of the valve body guide column, a second end of the valve body guide column is connected to the valve core after passing through a second through hole on the housing, and the valve body guide column is slidably arranged in the second through hole.

In a case where the above technical solutions are adopted, the centrifugal assembly is provided inside the lifting device in the present disclosure, and the middle rotating shaft at the middle part of the balancing rod is used as a fixed shaft, so that the counterweight guide column and the valve body guide column hinged at both ends of the balancing rod respectively can perform a lever motion. The counterweight member is arranged at the second end of the counterweight guide column, so that the valve body guide column can drive the valve core to disengage from the water outlet. A spring is provided on an inner surface of the housing at the top of the counterweight member, and the spring can provide a pre-pressure for the valve core. Under the action of the spring which simultaneously exerts a certain pressure to the housing and the first end of the balancing rod, the counterweight member abuts against an outer surface of the housing under the action of the force of the spring, and the other end of the spring transfers the force received by the first end of the balancing rod to the second end of the balancing rod, and then to the second end of the valve body guide column, ultimately tightly sealing the valve core at the water outlet by the valve body guide column. When the washing machine is in a spinning mode, the inner cylinder rotates at a high speed. When the centrifugal force between the valve body guide column and the valve core is greater than the pressure provided by the spring, the valve body guide column moves in a direction toward an axial center the inner cylinder until the valve core disengages from the water outlet to achieve drainage of the washing machine.

BRIEF DESCRIPTION OF DRAWINGS

Preferred embodiment of the present disclosure will be described below in connection with the accompanying drawings, in which.

LIST OF REFERENCE SIGNS

Figure 1:
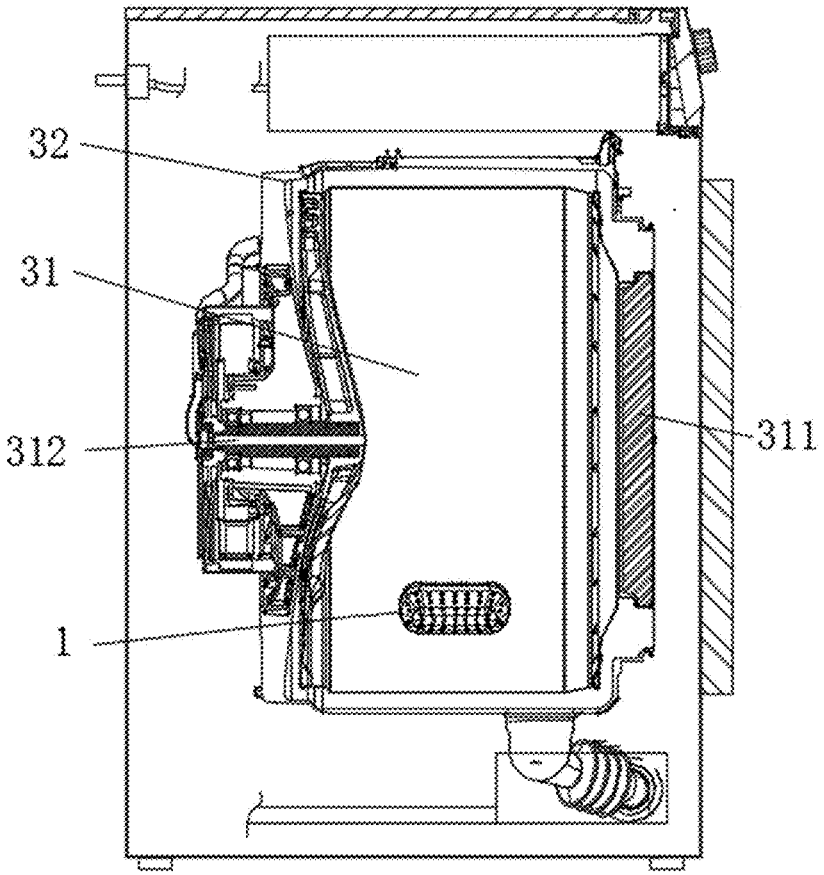
FIG. 1 is a schematic structural view of the drum washing machine of the present disclosure.

1: lifting device; 11: lifting rib shell; 111: water passing hole; 12: bracket; 121: first through hole; 122: second through hole; 123: support seat; 1231: middle rotating shaft; 2: centrifugal assembly; 21: valve body guide column; 211: second connecting lug; 212: second sliding rod; 213: second boss; 21*a*: first end of valve body guide column; 21*b*: second end of valve body guide column; 22: valve core; 221: sealing member; 2211: annular sealing rib; 23: counterweight guide column; 23*a*: first end of counterweight guide column; 23*b*: second end of counterweight guide column; 231: first connecting lug; 232: first sliding rod; 233: boss; 24: counterweight member; 25: balancing rod; 251: first rotating shaft; 2511: first rotating shaft hole; 252: second rotating shaft; 2521: second rotating shaft hole; 25*a*: first end of balancing rod; 25*b*: second end of balancing rod; 26: elastic member; A: size of counterweight member; B: size of first through hole; C: size of valve core; D: size of second through hole; 3: washing machine; 31: inner cylinder; 311: door; 312: water inlet; 32: outer cylinder:

DETAILED DESCRIPTION

Preferred embodiments of the present disclosure will be described below with reference to the accompanying drawings. It should be understood by those skilled in the art that these following embodiments are only used to explain the technical principle of the present disclosure, and are not intended to limit the scope of protection of the present disclosure. Those skilled in the art can make adjustments to them as required for adapting to specific application scenes.

It should be noted that in the description of the present disclosure, terms indicating directional or positional relationships, such as "upper", "lower", "left", "right", "vertical", "horizontal", "inner", "outer" and the like, are based on the directional or positional relationships shown in the accompanying drawings. They are only used for ease of description, and do not indicate or imply that the device or element must have a specific orientation, or must be constructed or operated in a specific orientation; therefore, they should not be considered as limitations to the present disclosure. In addition, terms "first" and "second" are only used for descriptive purpose, and should not be understood as indicating or implying relative importance.

In addition, it should also be noted that in the description of the present disclosure, unless otherwise clearly specified and defined, terms "install", "communicate" and "connect" should be understood in a broad sense; for example, the connection may be a fixed connection, or a detachable connection, or an integral connection; it may be a mechanical connection, or an electrical connection; it may be a direct connection, or an indirect connection implemented through an intermediate medium, or internal communication between two elements. For those skilled in the art, the specific meaning of the above terms in the present disclosure can be interpreted according to specific situations.

Figure 2:
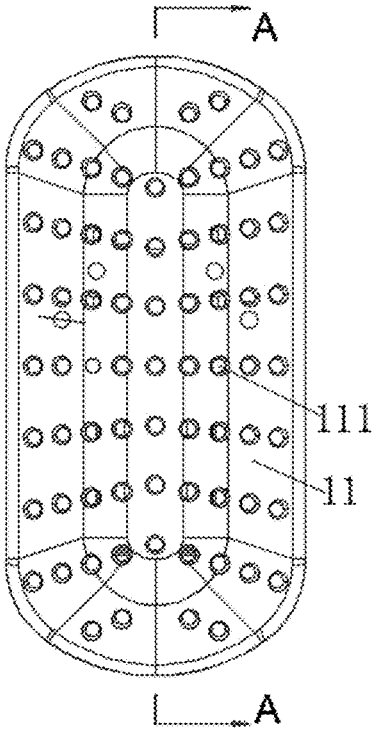
FIG. 2 is a schematic view of the lifting device of the present disclosure.
Figure 3:
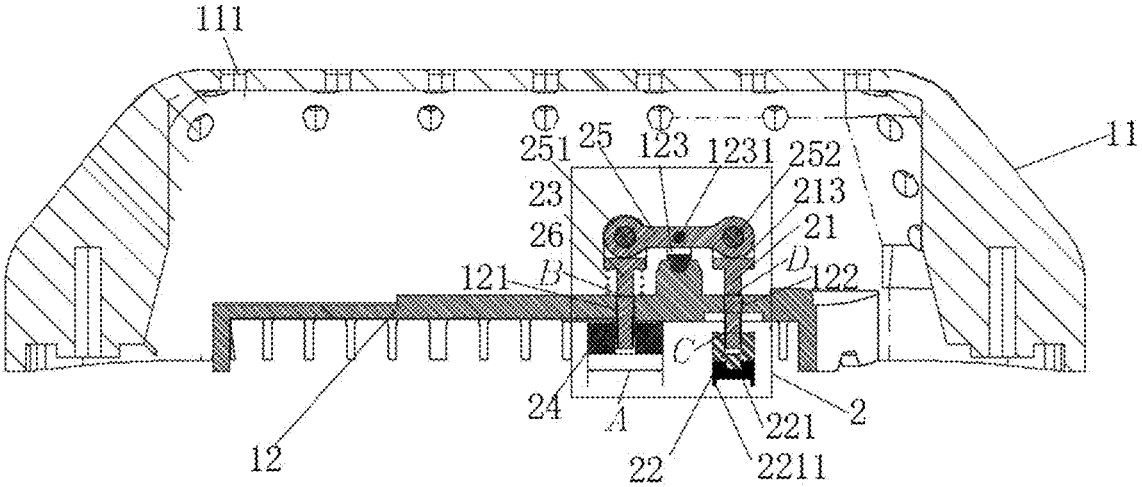
FIG. 3 is a cross-sectional view taken along line A-A in FIG. 2.
Figure 4:
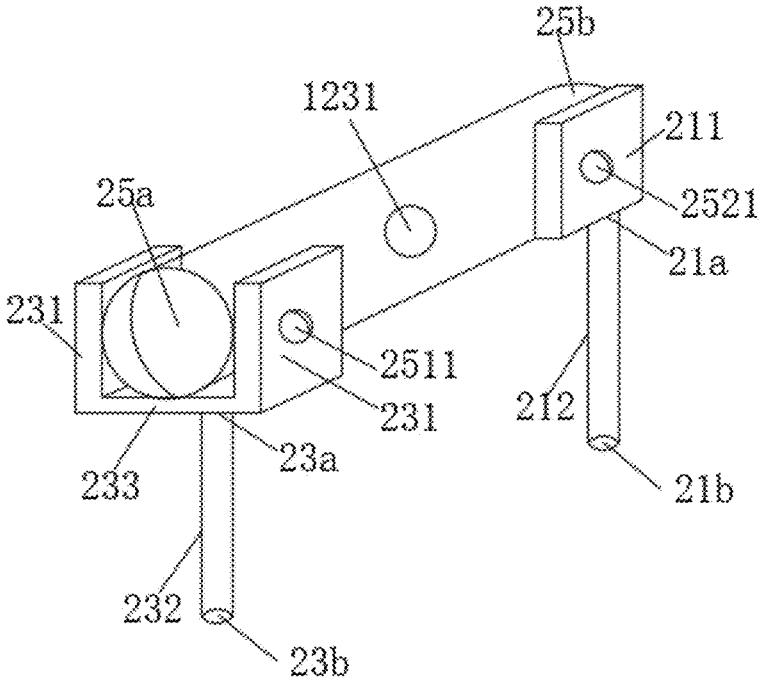
FIG. 4 is a schematic view of the connection between the balancing rod, the valve body guide column and the counterweight guide column of the lifting device of the present disclosure.

As shown in FIGS. 2-4, in order to solve the problem of reduced service life caused by unreasonable arrangement of the centrifugal assembly in the lifting device of existing drum washing machines, the lifting device 1 for a drum washing machine 3 of the present disclosure includes a housing with a cavity structure; as shown in FIG. 3, the housing includes a cover shaped lifting rib shell 11, and a bracket 12 arranged at an opening of the lifting rib shell 11. A centrifugal assembly 2 is arranged inside the cavity structure. The centrifugal assembly 2 includes a valve body guide column 21, a valve core 22, a counterweight guide column 23, a counterweight member 24, a balancing rod 25, and an elastic member 26. A middle part of the balancing rod 25 is pivotally connected inside the housing, and a first end 25*a* of the balancing rod is hinged to a first end 23*a* of the counterweight guide column through a first rotating shaft 251 and a first rotating shaft hole 2511. A second end 23*b* of the counterweight guide column is connected to the counterweight member 24 after passing through a first through hole 121 on the housing, and the counterweight guide column 23 is slidably arranged in the first through hole 121. The elastic member 26 is arranged between the counterweight guide column 23 and the housing, and is used to reset the position of the counterweight member 24. A second end 25*b* of the balancing rod is hinged to a first end 21*a* of the valve body guide column through a second rotating shaft 252 and a second rotating shaft hole 2521. A second end 21*b* of the valve body guide column is connected to the valve core 22 after passing through a second through hole 122 on the housing. The valve body guide column 21 is slidably arranged in the second through hole 122, and the first through hole 121 and the second through hole 122 are arranged on the bracket 12. As shown in FIG. 4, preferably, the counterweight guide column 23 includes a first connecting lug 231 and a first sliding rod 232 arranged on the first connecting lug 231. The first end of the balancing rod 25 is hinged to the first connecting lug 231 through the first rotating shaft 251 and the first rotating shaft hole 2511. A boss 233 is provided between the first connecting lug 231 and the first sliding rod 232. The elastic member 26 is a spring, which is sleeved on the first sliding rod 232. One end of the spring abuts against the boss 233, and the other end of the spring abuts against an inner surface of the bracket 12. Of course, the elastic member 26 can also be another elastic member, such as a leaf spring, an elastic rod, etc. Preferably, the first sliding rod 232 is threaded with the counterweight member 24, and the counterweight member 24 abuts against an outer surface of the bracket 12. In addition, as shown in FIG. 3, a size A of the counterweight member 24 is larger than a size B of the first through hole 121, and a size C of the valve core 22 is larger than a size D of the second through hole 122. As shown in FIG. 4, the valve body guide column 21 includes a second connecting lug 211 and a second sliding rod 212 arranged on the second connecting lug 211. The second end 25*b* of the balancing rod is hinged to the second connecting lug 211 through the second rotating shaft 252 and the second rotating shaft hole 2521. In addition, the valve body guide column 21 can also have a structure similar to that of the counterweight guide column 23, that is, the valve body guide column 21 can also include a second boss 213 as shown in FIG. 3. The valve core 22 is detachably connected to the second sliding rod 212, and a sealing member 221 is also provided at the top of the valve core 22. An annular sealing rib 2211 is also provided at the bottom of the sealing member 221. A support seat 123 is provided on the bracket 12, and a middle part of the balancing rod 25 is pivotally connected to the support seat 123 through a middle rotating shaft 1231. As shown in FIGS. 2 and 3, water passing holes 111 are provide on the lifting rib shell 11.

As shown in FIG. 1, the present disclosure also provides a drum washing machine 3, which includes an outer cylinder 32, and an inner cylinder 31 that is rotatably arranged inside the outer cylinder 32; the inner cylinder 31 is provided with a clothing inlet that cooperates with a door 311 of the washing machine 3, a water inlet 312 connected to a water inflow pipe, and a water outlet; the lifting device 1 for the drum washing machine 3 according to any of the above embodiments is provided on the water outlet, and the valve core 22 of the lifting device 1 is arranged at the water outlet, so that when the door 311 is closed, the water inlet 32 is closed and the valve core 22 blocks the water outlet, the inner cylinder 31 is a closed chamber, and when the door 311 is closed, the water inlet 312 (not shown) is closed and the valve core 22 disengages from the water outlet, the inner cylinder 31 can drain water normally.

When the drum washing machine 3 of the present disclosure is in a rinsing or washing program stage, the inner cylinder 31 rotates at a low speed, and the rotational speed of the inner cylinder 31 of the washing machine 3 is controlled at $V<V0$, where $V0$ is the speed at which the inner cylinder 31 drives the centrifugal assembly 2 to just open the water outlet during the rotation process. At this time, the force received by the centrifugal assembly 2 is not enough to make it disengage from the water outlet, and the clothing is rinsed or washed normally in the completely sealed inner cylinder 31. After the rinsing or washing program is completed, the washing machine 3 enters a spinning program. During the spinning process of the washing machine 3, the inner cylinder 31 rotates at a high speed, and the rotational speed V of the inner cylinder 31 of the washing machine 3 is controlled to be $V\geq V0$. At this time, the centrifugal assembly 2 disengages from the water outlet under the action of centrifugal force. The inner cylinder 31 maintains the rotational speed V for a period of time until the water in the inner cylinder 31 is completely discharged. Then, the spinning program of the washing machine 3 ends, the inner cylinder 31 stops rotating, and the centrifugal assembly 2 blocks the water outlet again. At this time, the washing machine 3 is controlled to enter the next program.

The above arrangement has the following advantages: the centrifugal assembly 2 is provided inside the lifting device 1, the middle rotating shaft 1231 at the middle part of the balancing rod 25 is used as a fixed shaft, and the support seat 123 fixes the middle rotating shaft 1231 on the bracket 12, so that the counterweight guide column 23 and the valve body guide column 21 hinged at both ends of the balancing rod 25 respectively can perform a lever motion. The first connecting lug 231 at the first end 23*a* of the counterweight guide column is connected to the first end 25*a* of the balancing rod, and the second connecting lug 211 at the first end 21*a* of the valve body guide column is connected to the second end 25*b* of the balancing rod. The design of the connecting lugs makes the connection structure less prone to wear and failure. The counterweight member 24 is provided at the second end 23*b* of the counterweight guide column, so that the valve body guide column 21 can drive the valve core 22 to disengage from the water outlet. A spring is provided on the inner surface of the bracket 12 at the top of the counterweight member 24, and the spring can provide a pre-pressure for the valve core 22. Under the action of the spring which simultaneously exerts a pressure to the bracket 12 and the boss 233, the counterweight member 24 abuts against the outer surface of the bracket 12 under the action of the force of the spring, and at the same time, the force received by the boss 233 is transmitted to the second end 25*b* of the balancing rod, and then to the second end 21*b* of the valve body guide column, ultimately tightly sealing the sealing member 221 located at the bottom of the valve core 22 at the water outlet by the valve body guide column 21. When the washing machine 3 is in a spinning mode, the inner cylinder 31 rotates at a high speed. When the centrifugal force between the valve body guide column 21 and the valve core 22 is larger than the pressure provided by the spring, the valve body guide column 21 moves in a direction toward an axial center the inner cylinder 31 until the sealing member 221 at the bottom of the valve core 22 disengages from the water outlet to achieve drainage of the washing machine 3. The first through hole 121 and the second through hole 122 on the bracket 12 provide a space for the up and down movement of the counterweight guide column 23 and the valve body guide column 21. Meanwhile, in order to prevent the counterweight guide column 23 and the valve body guide column 21 from disengaging from the bracket 12 during the movement, which may cause the centrifugal assembly 2 to fail and result in ineffective blocking of the water outlet, the size A of the counterweight member 24 is set to be larger than the size B of the first through hole 121, and the size C of the valve core 22 is set to be larger than the size D of the second through hole 122. This setting can also ensure that the valve core 22 operates within the range of motion specified in the present disclosure, increasing safety and effectiveness during use. The lifting rib shell 11 is provided with water passing holes 111. When the washing machine 3 is in a washing mode, if the lifting device 1 is located at an upper part of the inner cylinder 31, the water in the cavity of the lifting device 1 sprays downward through the water passing holes 111. When the washing machine 3 is in a drainage mode, the water in the inner cylinder 31 enters the lifting device 1 through the water passing holes 111 and is finally discharged from the water outlet. By connecting the first sliding rod 232 of the counterweight guide column 23 with the counterweight member 24 through threads, the magnitude of the pre-pressure of the spring exerted on the valve core 22 can be adjusted. When the counterweight member 24 is connected to the middle part of the first sliding rod 232 through threads, the distance between the bracket 12 and the boss 233 becomes smaller, and the pressure exerted on the spring is larger. Therefore, the pressure transmitted to the valve core 22 is also larger, and the sealing member 221 blocks the water outlet tightly. When the counterweight member 24 is connected to the bottom of the first sliding rod 232 through threads, the distance between the bracket 12 and the boss 233 becomes larger, and the pressure exerted on the spring is smaller. At this time, the pressure transmitted to the valve core 22 is smaller, and the sealing member 221 blocks the water outlet loosely. The way of connecting the counterweight member 24 with the counterweight guide column 23 through threads can realize the adjustment of the blocking degree of the water outlet by adjusting the counterweight member 24.

The inner cylinder 31 of the drum washing machine 3 of the present disclosure is only provided with the water inlet 312, the water outlet, and the clothing inlet. There is no need to fill the washing and rinsing water between the inner cylinder and the outer cylinder 32 before and during the washing process, which greatly reduces the amount of washing water of the washing machine 3 and also avoids the possibility of dirt adhesion between the inner cylinder and the outer cylinder 32.

As shown in FIG. 3, in a possible implementation, the counterweight member 24 and the counterweight guide column 23 are separately arranged or integrally formed, and the valve body guide column 21 and the valve core 22 are separately arranged or integrally formed. The detachable connection can be realized through threaded connection or through snap-fit connection.

The above arrangement has the following advantages: as shown in FIG. 3, the valve body guide column 21 and the valve core 22 are detachably connected through threads, and the counterweight member 24 and the counterweight guide column 23 are detachably connected through threads. This detachable connection can facilitate replacement of parts, and if one of the parts is damaged during use, this detachable connection can prevent the replacement of this part and all mating parts thereof. The detachable connection also includes snap-fit connection (not shown in the drawings). By integrally forming the counterweight member 24 and the counterweight guide column 23, and integrally forming the valve body guide column 21 and the valve core 22, the number of parts can be reduced and the assembly difficulty can be lower.

In summary, the centrifugal assembly 2 is provided inside the lifting device 1, and the middle rotating shaft 1231 at the middle part of the balancing rod 25 is used as a fixed shaft, so that the counterweight guide column 23 and the valve body guide column 21 hinged at both ends of the balancing rod 25 respectively can perform a lever motion. The counterweight member 24 provided at the second end 23*b* of the counterweight guide column can make the valve body guide column 21 drive the valve core 22 to disengage from the water outlet. A spring is provided on the inner surface of the bracket 12 at the top of the counterweight member 24, and the spring can provide a pre-pressure for the valve core 22, ultimately tightly sealing the sealing member 221 located at the bottom of the valve core 22 at the water outlet by the valve body guide column 21. When the washing machine 3 is in the spinning mode, if the centrifugal force between the valve body guide column 21 and the valve core 22 is larger than the pressure provided by the spring, the valve body guide column 21 moves in a direction toward an axial center the inner cylinder 31 until the sealing member 221 at the bottom of the valve core 22 disengages from the water outlet to achieve drainage of the washing machine 3. In order to prevent the counterweight guide column 23 and the valve body guide column 21 from disengaging from the bracket 12 during the movement, the size A of the counterweight member 24 is set to be larger than the size B of the first through hole 121, and the size C of the valve core 22 is set to be larger than the size D of the second through hole 122. By connecting the first sliding rod 232 of the counterweight guide column 23 with the counterweight member 24 through threads, the magnitude of the pre-pressure of the spring exerted on the valve core 22 can be adjusted. When the counterweight member 24 is connected to the middle part of the first sliding rod 232, the pressure exerted on the spring becomes larger. Therefore, the pressure transmitted to the valve core 22 is also larger, and the sealing member 221 blocks the water outlet tightly. When the counterweight member 24 is connected to the bottom of the first sliding rod 232, the pressure exerted on the spring becomes smaller. At this time, the pressure transmitted to the valve core 22 is smaller, and the sealing member 221 blocks the water outlet loosely, ultimately realizing the adjustment of the blocking degree of the water outlet by adjusting the counterweight member 24.

It should be noted that the above embodiments are only used to illustrate the principles of the present disclosure, and are not intended to limit the scope of protection of the present disclosure. Without departing from the principles of the present disclosure, those skilled in the art can adjust the above structures so that the present disclosure can be applied to more specific application scenes.

Hitherto, the technical solutions of the present disclosure have been described in connection with the preferred embodiments shown in the accompanying drawings, but it is easily understood by those skilled in the art that the scope of protection of the present disclosure is obviously not limited to these specific embodiments. Without departing from the principles of the present disclosure, those skilled in the art can make equivalent changes or replacements to relevant technical features, and all the technical solutions after these changes or replacements will fall within the scope of protection of the present disclosure.

What is claimed is:

1. A lifting device for a drum washing machine, wherein the lifting device comprises a housing with a cavity structure; a centrifugal assembly is arranged inside the cavity structure, and the centrifugal assembly comprises a valve body guide column, a valve core, a counterweight guide column, a counterweight member, a balancing rod, and an elastic member;

a middle part of the balancing rod is pivotally connected inside the housing;

a first end of the balancing rod is hinged to a first end of the counterweight guide column, a second end of the counterweight guide column is connected to the counterweight member after passing through a first through hole on the housing, and the counterweight guide column is slidably arranged in the first through hole;

the elastic member is arranged between the counterweight guide column and the housing, and is used to reset the position of the counterweight member;

a second end of the balancing rod is hinged to a first end of the valve body guide column, a second end of the valve body guide column is connected to the valve core after passing through a second through hole on the housing, and the valve body guide column is slidably arranged in the second through hole;

wherein the housing comprises a cover shaped lifting rib shell and a bracket arranged at an opening of the lifting rib shell, and the first through hole and the second through hole are arranged on the bracket;

wherein the counterweight guide column comprises a first connecting lug and a first sliding rod arranged on the first connecting lug; the first end of the balancing rod is hinged to the first connecting lug, and a boss is arranged between the first connecting lug and the first sliding rod; the elastic member is a spring, which is sleeved on the first sliding rod; one end of the spring abuts against the boss, and the other end of the spring abuts against an inner surface of the bracket.

2. The lifting device for a drum washing machine according to claim 1, wherein the first sliding rod is threaded with the counterweight member, and the counterweight member abuts against an outer surface of the bracket.

3. The lifting device for a drum washing machine according to claim 1, wherein a size of the counterweight member is larger than a size of the first through hole, and/or a size of the valve core is larger than a size of the second through hole.

4. The lifting device for a drum washing machine according to claim 1, wherein the valve body guide column comprises a second connecting lug and a second sliding rod arranged on the second connecting lug; the second end of the balancing rod is hinged to the second connecting lug, the valve core is detachably connected to the second sliding rod, and a sealing member is also arranged at the top of the valve core.

5. The lifting device for a drum washing machine according to claim 4, wherein an annular sealing rib is also arranged at the bottom of the sealing member.

6. The lifting device for a drum washing machine according to claim 1, wherein a support seat is arranged on the bracket, and a middle part of the balancing rod is pivotally connected to the support seat; and/or water passing holes are arranged on the lifting rib shell.

7. The lifting device for a drum washing machine according to claim 1, wherein the counterweight member and the counterweight guide column are separately arranged or integrally formed; and/or the valve body guide column and the valve core are separately arranged or integrally formed.

8. A drum washing machine, wherein the drum washing machine comprises an outer cylinder, and an inner cylinder that is rotatably arranged inside the outer cylinder; the inner cylinder is provided with a clothing inlet that cooperates with a door of the washing machine, a water inlet connected to a water inflow pipe, and a water outlet; the lifting device for a drum washing machine according to claim 1 is provided on the water outlet, and the valve core of the lifting device is arranged at the water outlet, so that when the door is closed, the water inlet is closed and the valve core blocks the water outlet, the inner cylinder is a closed chamber, and when the door is closed, the water inlet is closed and the valve core disengages from the water outlet, the inner cylinder can drain water normally.

* * * * *